United States Patent [19]

Hribernik et al.

[11] Patent Number: 5,034,282

[45] Date of Patent: Jul. 23, 1991

[54] PROCESS FOR THE POWDER METALLURGICAL PRODUCTION OF WORKING PIECES OR TOOLS AND PM PARTS

[75] Inventors: Bruno Hribernik, Bruck a.d.Mur; Gerhard Hackl, Kapfenberg, both of Austria

[73] Assignee: Boehler Gesellschaft m.b.H., Kapfenberg, Austria

[21] Appl. No.: 487,048

[22] Filed: Mar. 5, 1990

[30] Foreign Application Priority Data

Mar. 6, 1989 [AT] Austria ..... 491/89

[51] Int. Cl.[5] ..... B22F 3/00

[52] U.S. Cl. ..... 428/552; 75/236; 75/238; 75/242; 75/244; 428/627; 148/11.5 P; 419/13; 419/14; 419/23; 419/31; 419/33

[58] Field of Search ..... 419/31, 33, 13, 14, 419/15, 23; 75/244, 236, 238, 242; 428/552, 627, 457, 698, 704; 148/11.5 P

[56] References Cited

U.S. PATENT DOCUMENTS

| | | | |
|---|---|---|---|
| 4,469,514 | 9/1984 | Holtz, Jr. | 75/236 |
| 4,609,526 | 9/1986 | Haswell et al. | 419/23 |
| 4,639,352 | 1/1987 | Kodama et al. | 419/15 |
| 4,885,132 | 12/1989 | Brandt et al. | 419/15 |
| 4,891,338 | 1/1990 | Gesing et al. | 501/87 |
| 4,911,989 | 3/1990 | Minoru et al. | 428/547 |
| 4,935,057 | 6/1990 | Yoshimura et al. | 75/238 |
| 4,942,097 | 7/1990 | Santhanam et al. | 428/552 |
| 4,944,800 | 7/1990 | Kolaska et al. | 75/238 |

FOREIGN PATENT DOCUMENTS 2732966 2/1979 Fed. Rep. of Germany .

*Primary Examiner*—Robert L. Stoll
*Assistant Examiner*—Nina Bhat
*Attorney, Agent, or Firm*—Fleit, Jacobson, Cohn, Price, Holman & Stern

[57] ABSTRACT

Process for the powder-metallurgical production of work pieces, particularly tools, containing high-melting point carbides and/or carbonitrides homogeneously distributed in a matrix, in which an amount of elements of the IVa and Va groups, or secondary groups, of the periodic table is adjusted to at least 3 weight percent of the alloy, a low carbon and/or nitrogen concentration is established, and primary precipitates are prevented; and a desired carbon and/or nitrogen content is created by atomization of the melt into powder vaporizing medium. When necessary, it is further created by diffusion annealing of the powder in a medium containing carbon or hydrocarbon compounds and/or nitrogen or nitrogen compounds; and powder with a minimum carbide and/or carbonitride content of 10 percent by volume is processed to produce work pieces in a manner known in the prior art, when necessary after mixing two or more kinds of powders containing different amounts of carbon and nitrogen made according to the process of this invention. Work pieces, particularly tools, produced according to this process have a content of at least two elements selected from the group consisting of vanadium, niobium, titanium, zirconium, hafnium or tantalum, with a carbide and/or carbonitride content of at least 6 percent by volume, and a maximum carbide and/or carbonitride granule size of 5 μm diameter.

16 Claims, No Drawings

PROCESS FOR THE POWDER METALLURGICAL PRODUCTION OF WORKING PIECES OR TOOLS AND PM PARTS

BACKGROUND OF THE INVENTION

The invention relates to a process for the powder metallurgical production of work pieces or tools containing high melting point carbides and/or carbonitrides that are homogeneously distributed in the matrix and PM parts produced according to this process.

In the process for the production of work pieces or tools, particularly when they are produced from alloys containing a high amount of carbon, for example, cold work steels, high-speed steels, and the like, and/or containing high nitrogen concentrations, powder metallurgical processes can be employed to advantage. In the process a molten alloy is atomized to form a powder, this powder is filled into capsules, and a PM (powder metallurgy) part is produced by means of sintering, HIP-ing (hot isostatic pressing), and/or hot-forming and the like. When the particle formed by atomization of a homogeneous melt of the alloy is rapidly cooled, the reaction of the carbon and/or nitrogen with the elements contained in the alloy which elements form carbides and/or nitrides occurs in a brief period of time. As a result, the washing of coarse carbides and/or carbonitrides is prevented from forming during hardening and a uniform distribution of fine particles of these compounds in the powder granules is achieved. The end products, PM parts consequently have a homogeneous distribution of carbides and/or carbonitrides of small granular size in a matrix, which particularly improves the toughness and performance properties.

The usable contents of carbon and nitrogen in the alloy are limited in combination with the amount of carbide-forming and/or nitride -forming elements of the IVa and Va groups, or secondary groups, of the periodic table, because when the amounts of carbon and nitrogen are high, the carbides and/or carbonitrides of the elements already form in the melt due to the high affinities between these elements and carbon and/or nitrogen. These primarily precipitated compounds have high melting points and grow in size in the melt to be mostly block-like and/or dendritic granules, which cannot be reduced even in the atomizing process. This may result in inhomogeneities and scarring in coarse carbides in the resulting PM part, which negatively affects the operating properties of the latter, particularly its toughness qualities.

Attempts have been made in the case of higher concentrations, particularly of the elements C and Nb, to prevent the formation of coarse primary carbide precipitates by the means of technical alloying procedures or influencing the nuclear condition of the melt. However, they have not been able to achieve any significant improvements.

Also proposed in the case of alloys containing elements of more than 3.0 percent in weight which form carbides of the type of MeC and $Me_4C_3$, (where Me means metal and C means carbon, or carbides) was superheating at the temperatures far above the usual melting temperatures, for example 1750° to 1800° C., in order to thereby dissolve primary carbide precipitates or to avoid them, and rapid cooling of the alloy from this temperature. The disadvantage here is that the fireproof linings of the furnace for melt and atomization aggregates wear away quickly. Furthermore, at high temperatures the affinities of the elements, for example of niobium and titanium for oxygen, are considerably increased, whereby oxide formations are increased, which causes impurities in the melt and an uncontrollable combustion of the elements.

SUMMARY OF THE INVENTION

The invention is based on the problem of removing the above indicated disadvantages and creating a process according to which work pieces or tools can be produced with high-melting point carbides, nitrides, and/or carbonitrides, homogeneously distributed in the matrix of the tool steel, of elements of the IVa and Va groups, or secondary groups, of the periodic table. Hereinafter, the designation of groups IVa, and Va of the periodic table corresponds to the conventional U.S. designation of groups IVb and Vb in the periodic table.

This problem is solved by the invention with the process described in detail below. Here it is important that the amounts of carbon and nitrogen in the molten alloy, which is atomized to form a powder, is adjusted before melting below a threshold depending on the total concentration of the elements of the IVa and Va groups, of the periodic table and that in order to enrich carbon and/or nitrogen to the desired amount, the atomizing medium contains carbon compounds and/or nitrogen and/or that diffusion annealing of the powder is performed at a temperature between the austenitizing and 50° C. below the distortion temperature of the alloy and that, under certain circumstances, this annealing is performed at given amounts or at given partial pressures, of gaseous carbon compounds and/or nitrogen, particularly for diffusion of the powder. A special advantage is conferred if two or several powders produced according to the inventive process which have different compositions and/or different amounts of carbon and nitrogen are homogeneously mixed and the PM part is produced from this mixed powder, since this procedure affords an optimal adjustment of the composition or affords optimal adjustment of the operating properties of the part, with lower storage periods or lower costs.

It has proven to be the case that, even with concentrations of more than 3% in weight of—particularly several—elements of the IVa and Va groups, or secondary groups, of the periodic table, the precipitation of carbides and carbonitrides from a melt can be prevented by lowering the amount of carbon in the alloy. Given a minimum content of these elements, there is a reciprocal influence, allowing the upper threshold value for carbon and nitrogen—beyond which carbide and/or carbonitride will precipitate—to be determined and calculated. The threshold value K for C in weight percent and the threshold value S for N in ppm in weight are calculated according to the following formulas respectively;

$$K = 0.6 + \frac{0.2}{\text{Ti }\%} + \frac{0.12}{\text{Zr }\%} + \frac{0.06}{\text{Hf }\%} + \frac{0.19}{\text{V }\%} + \frac{0.12}{\text{Nb }\%} + \frac{0.06}{\text{Ta }\%}$$

$$S = 150 + \frac{190}{(\text{Ti} + \text{Zr} + \text{Hf})\ \%} + \frac{100}{(\text{V} + \text{Nb} + \text{Ta})\ \%}$$

The amounts in weight percent employed in the formulas are at least 0.7 for Ti, 1.0 for Zr, 1.1 for V, 0.8 for Nb, 1.0 for Hf and 1.0 for Ta. Unexpectedly, it was discovered that in the process of an atomization of the liquid of molten alloy in the gaseous atomization mediums containing hydrocarbon and/or nitrogen, the area of the powder granules close to the surface can absorb carbon and nitrogen and that this phenomenon is particularly effective when a granule surface is less than 0.9 $mm^2$. The specialist found it particularly surprising that an enrichment of carbon and/or nitrogen in the area close to the granule surface—an enrichment even produced by annealing the powder in an atmosphere containing e.g. hydrocarbon and/or nitrogen—can be equalized by diffusion annealing or by sintering, HIP-ing, and warm rolling, and that the carbon and/or nitrogen atoms migrating in the granule form high melting point carbides and/or carbonitrides. The resulting carbides and/or carbonitrides are homogeneously distributed and have a very small granule size. There is still no scientific explanation for this effect, but it is conceivable that one of the causes is the different diffusion speeds of various atoms.

Contrary to the specialist preconception, it was also discovered that a homogeneous PM part or a tool having uniform distribution of carbides and/or nitrides having a granular size of less than 5 μm could be produced from mixtures of variously composed powders, or powders having different amounts of carbon and/or nitrogen, if the surface of the powder granule was smaller than 0.9 $mm^2$. In testing PM parts of this type, the work material or tool was found to possess especially good mechanical properties when it had high amounts of carbide and/or carbonitride.

DETAILED DESCRIPTION OF THE INVENTION

The invention is described in great detail below on the basis of the exemplary embodiments:

EXAMPLE 1

An alloy having the following composition in weight-%

C=0.75
W=6.64
Mo=4.80
Cr=4.76
V=1.16
Nb=3.14 and a N concentration of 30 ppm, residual amount being basically Fe, was melted.

The examination of extracted samples, which were taken from the melt at a temperature of 1450° C., revealed to have no primary carbide or carbonitride precipitates.

The melt was atomized to form a powder in a medium containing helium, nitrogen, and hardening oil, which yielded fine powder granules having a largest surface of 0.6 $mm^2$. After compacting, hot isostatic pressing, and forming of the powders, the part formed into a tool had a carbon content of 1.32% by weight and a nitrogen concentration of 260 ppm; here the granule of the carbides and carbonitrides, which principally contained vanadium and niobium, 5 μm in diameter at maximum and its amount was 11% by volume. As compared with conventionally produced high speed steel S 6-5-1-3 Nb, the tool in heat-treated condition had considerably better operating properties and toughness values that were higher by about 28%.

EXAMPLE 2

An alloy having the following composition in weight-% was melted in an induction furnace:

C=0.56
Si=0.44
Mn=0.52
P=0.003
S=0.0029
Cr=4.50
Mo=3.70
W=2.40
V=1.76
Nb=3.22
Ti=1.74
residual amount: iron The nitrogen amount was 50 ppm; at 1440° C. carbide, carbonitride and nitride precipitates could not be identified. Atomization of the melt was performed in methane to form a powder having a maximum granule surface of 0.65 $mm^2$, whereupon the powder was subjected to diffusion annealing at a temperature of 910° C. and in a medium containing a gas mixture consisting of endothermic gas. After further processing of this powder in an evacuated capsule by hot forming at a temperature of 1185° C. to produce a PM part, the latter was examined after appropriate heat treatment. The test of the material showed the following values: amount of carbon, 1.48% by weight; amount of nitrogen, 250 ppm; maximum granule size of carbides, carbonitrides, and nitride principally containing vanadium, niobium, and titanium (determined by x-ray spectrum analysis), 4.5 μm; amount of carbide, carbonitride, and nitride, 13% by volume.

EXAMPLE 3

An alloy having a composition in weight-% of

C=0.78
Si=0.52
Mn=0.34
P=0.003
S=0.0025
Cr=4.6
Mo=3.74
W=2.86
V=2.14
Nb=6.9
Ti=0.86
residual amount=iron was melted in a furnace, first under a vacuum and then under protective gas, and was then atomized to form a powder having an average particle surface of 0.18 $mm^2$. One part of the powders was annealed with diffusion in an annealing installation at 1210° C. in a medium containing a methane—nitrogen mixture, after which the amount of carbon was 2.64% in weight.

PM parts and tools were produced from the vaporized powder (0.78% C.), the vaporized and annealed powder (2.64% C.), and a powder mixed in a ratio of approximately 50:50 of the vaporized powder to the vaporized and annealed powder (1.70% C.) respectively after HIP-ing and forming. Structural tests showed that there was a uniform distribution of carbides and carbonitrides in all parts, having a maximum granule size of 3.5 μm. The amount of carbide and carbonitride of the work material containing 0.78% by weight of C. was 6% by volume; that of the work material containing 1.70% by weight of C. was 14% by volume, and the PM part containing 2.64% by weight of C. had about 21% by volume of carbide and carbonitride. An extrusion punch having a particularly high material toughness was produced from the work material containing 0.78% by weight of C.; in practical application it brought an increase in performance of 285% as compared with cold work steel.

The PM part containing 1.70% by weight of C. was processed to form a milling tool, which was heat-treated, and covered with a hardened layer of TiN with a thickness of 3 μm according to a PVD (physical vapor deposition) process. The endurance life of the milling tool, even having a broken section, was considerably increased, and the TiN layer had especially good adherence properties. The hardened layer can be made also according to a CVD (chemical vapor deposition) process.

A forming tool especially to be subjected to heavy wear was produced from the PM part having 2.64% in weight of carbon and was covered with several layers of a Ti(CN) hard material. The good adherence properties of the layer and the excellent mechanical properties, in combination with a high degree of hardness and wear resistance assured by the high amount of carbon and the high material toughness, resulted in a superior endurance life in the practical use of the forming tool.

We claim:

1. A process for powder metallurgical production of work pieces containing at least one high melting point compound selected from the group consisting of carbides, nitrides and carbonitrides homogeneously distributed in a matrix, said process comprising the steps of:

a. adjusting the amount of at least one element selected from the group consisting of carbon and nitrogen in an alloy which contains at least two elements selected from the group consisting of groups IVa and Va of the periodic table and mixtures thereof in a weight percent of at least 0.3, so that primary precipitation of at least one of said carbides, nitrides or carbonitrides of said at least two elements is prevented from forming at temperatures above the melting temperature of said alloy;

b. atomizing said alloy when molten in a vaporizing medium to form a powder having a maximum particle surface of 0.9 $mm^2$, a predetermined amount of at least said element selected from the group consisting of carbon and nitrogen, and at least 6 percent by volume of said high melting point compound; and c. forming said work pieces by heating and compacting said powder.

2. The process as claimed in claim 1 comprising the further step of diffusion annealing said formed powder in a medium containing at least one member selected from the group consisting of carbon, carbon compounds, nitrogen and nitrogen compounds.

3. The process as claimed in claim 2 wherein two or more kinds of powder each containing different amounts of carbon and nitrogen made according to the process of claim 2 are homogeneously mixed to form said work piece.

4. The process as claimed in claim 1 wherein said alloy contains at least two elements selected from the group consisting of groups IVa and Va of the periodic table and mixtures thereof, said amount of carbon in weight percent is adjusted to a level below a value K calculated according to the following formula:

$$K = 0.6 + \frac{0.2}{\text{Ti }\%} + \frac{0.12}{\text{Zr }\%} + \frac{0.06}{\text{Hf }\%} + \frac{0.19}{\text{V }\%} + \frac{0.12}{\text{Nb }\%} + \frac{0.06}{\text{Ta }\%}$$

said amount of nitrogen in ppm by weight is adjusted to a level below a value S calculated according to the following formula;

$$S = 150 + \frac{190}{(\text{Ti} + \text{Zr} + \text{Hf})\,\%} + \frac{100}{(\text{V} + \text{Nb} + \text{Ta})\,\%}$$

and the amounts of the elements employed in said formulas in weight percent are at least 0.7 for Ti, 1.0 for Zr, 1.1 for V, 0.8 for Nb, 1.0 for Hf and 1.0 for Ta.

5. The process as claimed in claim 1 wherein said vaporizing medium contains at least one member selected from the group consisting of hydrocarbons and nitrogen.

6. The process as claimed in claim 2 wherein said powder is annealed at a temperature between the austenitizing temperature and 50° C. below the distortion temperature of said alloy, and said vaporizing medium is selected from the group consisting of solid, liquid and gas, said vaporizing medium releasing at least one member selected from the group consisting of carbon and hydrocarbon.

7. The process as claimed in claim 5 wherein the amount of said vaporizing member is adjusted in said vaporizing medium for atomizing in order to increase the amount of said high melting point compound.

8. The process as claimed in claim 2 wherein the amount of at least one member selected from the group consisting of carbon, carbon compounds, nitrogen and nitrogen compounds is adjusted in order to increase the volume of said high melting point compound.

9. The process as claimed in claim 6 wherein the annealing medium is gas and said gas is blown onto the surface of said powder and diffuses therein.

10. The process as claimed in claim 1 wherein two or more kinds of powder each containing different amounts of carbon and nitrogen made according to the process of claim 10 are homogeneously mixed to form said work piece.

11. The process as claimed in claim 1 and further comprising covering said work piece with a wear resistant coating.

12. The process as claimed in claim 11 wherein said wear resistant coating is TiN.

13. The process as claimed in claim 11 wherein said wear resistant coating is formed by chemical vapor deposition.

14. The process as claimed in claim 11 wherein said wear resistant coating is formed by physical vapor deposition.

15. A powder metallurgically produced work piece comprising a powder formed by atomization of a molten alloy containing at least two elements selected from the group consisting of groups IVa and Va of the periodic table and mixtures thereof in a weight percent of at least 3.0 in a vaporizing medium, said powder having a maximum particle surface of 0.9 $mm^2$, a predetermined amount of at least one element selected from the group consisting of carbon and nitrogen, at least 6 percent by volume of at least one high melting point compound selected from the group consisting of carbides and carbonitrides homogeneously distributed in a matrix, said at least one high melting point compound having a maximum granule size of 5 μm in diameter.

16. The powder metallurgically produced work piece as claimed in claim 15 wherein said powder is further formed by annealing with diffusion in a medium containing at least one member selected from the group consisting of carbon, carbon compounds, nitrogen and nitrogen compounds.

* * * * *